US009518524B2

(12) United States Patent
Satou et al.

(10) Patent No.: US 9,518,524 B2
(45) Date of Patent: Dec. 13, 2016

(54) FUEL INJECTION CONTROLLER

(71) Applicant: DENSO CORPORATION, Kariya, Aichi-pref. (JP)

(72) Inventors: Ayumi Satou, Kariya (JP); Hiromichi Katoh, Kasugai (JP); Mikio Teramura, Okazaki (JP); Yuuta Hosaka, Chiryu (JP); Kensuke Mizui, Toyota (JP)

(73) Assignee: DENSO CORPORATION, Kariya-city (JP)

( * ) Notice: Subject to any disclaimer, the term of this patent is extended or adjusted under 35 U.S.C. 154(b) by 275 days.

(21) Appl. No.: 14/306,374

(22) Filed: Jun. 17, 2014

(65) Prior Publication Data

US 2015/0027414 A1 Jan. 29, 2015

(30) Foreign Application Priority Data

Jul. 24, 2013 (JP) ..... 2013-153776

(51) Int. Cl.

| | |
|---|---|
| ***F02D 41/30*** | (2006.01) |
| ***F02D 41/04*** | (2006.01) |
| *F02D 41/40* | (2006.01) |
| *F02D 41/38* | (2006.01) |

(52) U.S. Cl.

CPC ..... *F02D 41/30* (2013.01); *F02D 41/047* (2013.01); *F02D 41/3005* (2013.01); *F02D 41/40* (2013.01); *F02D 41/401* (2013.01); *F02D 41/402* (2013.01); *F02D 2041/389* (2013.01)

(58) Field of Classification Search

CPC ..... F02D 41/04; F02D 41/047; F02D 1/16; F02D 35/0092; F02D 2200/0614; F02D 2200/0616

See application file for complete search history.

(56) References Cited

U.S. PATENT DOCUMENTS

| | | | | |
|---|---|---|---|---|
| 5,690,074 A * | 11/1997 | Ogawa | F02D 41/061 | 123/491 |
| 6,382,188 B2 * | 5/2002 | Hasegawa | F02D 41/047 | 123/179.16 |
| 6,856,889 B2 * | 2/2005 | Nagaishi | F02D 35/025 | 123/435 |

(Continued)

FOREIGN PATENT DOCUMENTS

| | | |
|---|---|---|
| JP | 2004-197630 A | 7/2004 |
| JP | 2006-322404 A | 11/2006 |

(Continued)

OTHER PUBLICATIONS

Japanese Office action mailed on Jul. 21, 2015 in the corresponding JP application No. 2013-153776 (English translation attached ).

*Primary Examiner* — Stephen K Cronin
*Assistant Examiner* — Kevin R Steckbauer
(74) *Attorney, Agent, or Firm* — Posz Law Group, PLC

(57) ABSTRACT

A fuel injection controller controls a fuel injector which injects a fuel directly into a cylinder of an engine. The fuel injection controller conducts a correction to increase a fuel injection quantity injected from the fuel injector according to a fuel-adhered quantity which is an amount of the fuel adhered to an opened intake valve. Thus, even when the fuel is adhered to the intake valve, an appropriate amount of the fuel can be injected into the cylinder.

3 Claims, 5 Drawing Sheets

(56) References Cited

U.S. PATENT DOCUMENTS

| | | | | |
|---|---|---|---|---|
| 7,275,515 | B2 * | 10/2007 | Ikoma | F02D 41/3029 123/299 |
| 7,987,043 | B2 * | 7/2011 | Tashima | F02D 41/0025 123/434 |
| 8,746,211 | B2 * | 6/2014 | Aso | F02D 41/0025 123/179.16 |
| 2001/0008134 | A1 * | 7/2001 | Hasegawa | F02D 41/047 123/491 |
| 2004/0181331 | A1 * | 9/2004 | Nagaishi | F02D 35/025 701/104 |
| 2005/0051147 | A1 * | 3/2005 | Nagaishi | F02D 41/047 123/676 |
| 2006/0207551 | A1 * | 9/2006 | Ikoma | F02D 41/3029 123/305 |

FOREIGN PATENT DOCUMENTS

| | | | |
|---|---|---|---|
| JP | 2007-291887 | A | 11/2007 |
| JP | 2008-014179 | A | 1/2008 |
| JP | 2008-121532 | A | 5/2008 |
| JP | 2009-052418 | A | 3/2009 |
| JP | 2013-87681 | A | 5/2013 |

* cited by examiner

FUEL INJECTION CONTROLLER

CROSS-REFERENCE TO RELATED APPLICATION

This application is based on Japanese Patent Application No. 2013-153776 filed on Jul. 24, 2013, the disclosure of which is incorporated herein by reference.

TECHNICAL FIELD

The present disclosure relates to a fuel injection controller for a cylinder-direct injection engine.

BACKGROUND

A cylinder-direct injection engine that injects fuel directly into a cylinder from a fuel injector has been known. In the engine of this type, there is a period in which a part of fuel injected from the fuel injector is adhered to an opened intake valve. This period is referred to as "interference period", hereinafter. When injection fuel is adhered to the intake valve, a required amount of fuel cannot be supplied into the cylinder.

For that reason, for example, JP-A-2007-291887 discloses an injection period in which fuel is injected from the fuel injector is changed to avoid the interference period. Specifically, the injection period is divided into a front and a back of the interference period. Alternatively, the overall injection period moves behind the interference period. Both of those techniques derive from an idea that a portion of the injection period which overlaps with the interference period moves behind the interference period.

In the above related art, the fuel injection is not implemented in the interference period. For that reason, there is a high possibility that a larger amount of fuel must be injected after the termination of the interference period.

The fuel injection into the cylinder needs to be implemented within a given injectable period, and when a period (hereinafter referred to as "margin period") from the termination time of the interference period to the termination time of the injectable period is shorter, a fuel injection for the avoided interference period cannot be implemented. In general, the interference period and the injectable period are determined according to a crank angle (rotation angle position of a crank shaft), in other words, intervals from one crank angle to another crank angle. Therefore, the margin period is shorter as an engine speed is higher. Hence, the above related art is more difficult to realize as the engine speed is higher.

SUMMARY

It is an object of the present disclosure to provide a fuel injection controller which is able to supply an appropriate amount of fuel into a cylinder even when the injection fuel from the fuel injector is adhered to the intake valve.

According to an aspect of the present disclosure, a fuel injection controller has a correction unit that corrects a fuel injection quantity injected from the fuel injector according to a fuel-adhered quantity which is the amount of fuel adhered to an opened intake valve.

The fuel injection controller corrects the amount of fuel injection according to the amount of fuel adhered to the valve assuming that the injected fuel from the fuel injector is adhered to the intake valve.

For that reason, even when the injection period in which the fuel is injected from the fuel injector overlaps with the interference period, and the injection fuel from the fuel injector is adhered to the intake valve, the appropriate amount of fuel can be supplied into the cylinder with the correction of a fuel injection quantity based on the amount of fuel adhered to the intake valve.

Also, because the fuel injection is also conducted in the interference period, there is no need to conduct the overall fuel injection for the injection period that overlaps with the interference period after the interference period. Hence, even when the above-mentioned margin period is shorter, the appropriate amount of fuel can be supplied into the cylinder.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

A fuel injection controller (hereinafter referred to as "ECU") according to an embodiment will be described.

Figure 1:
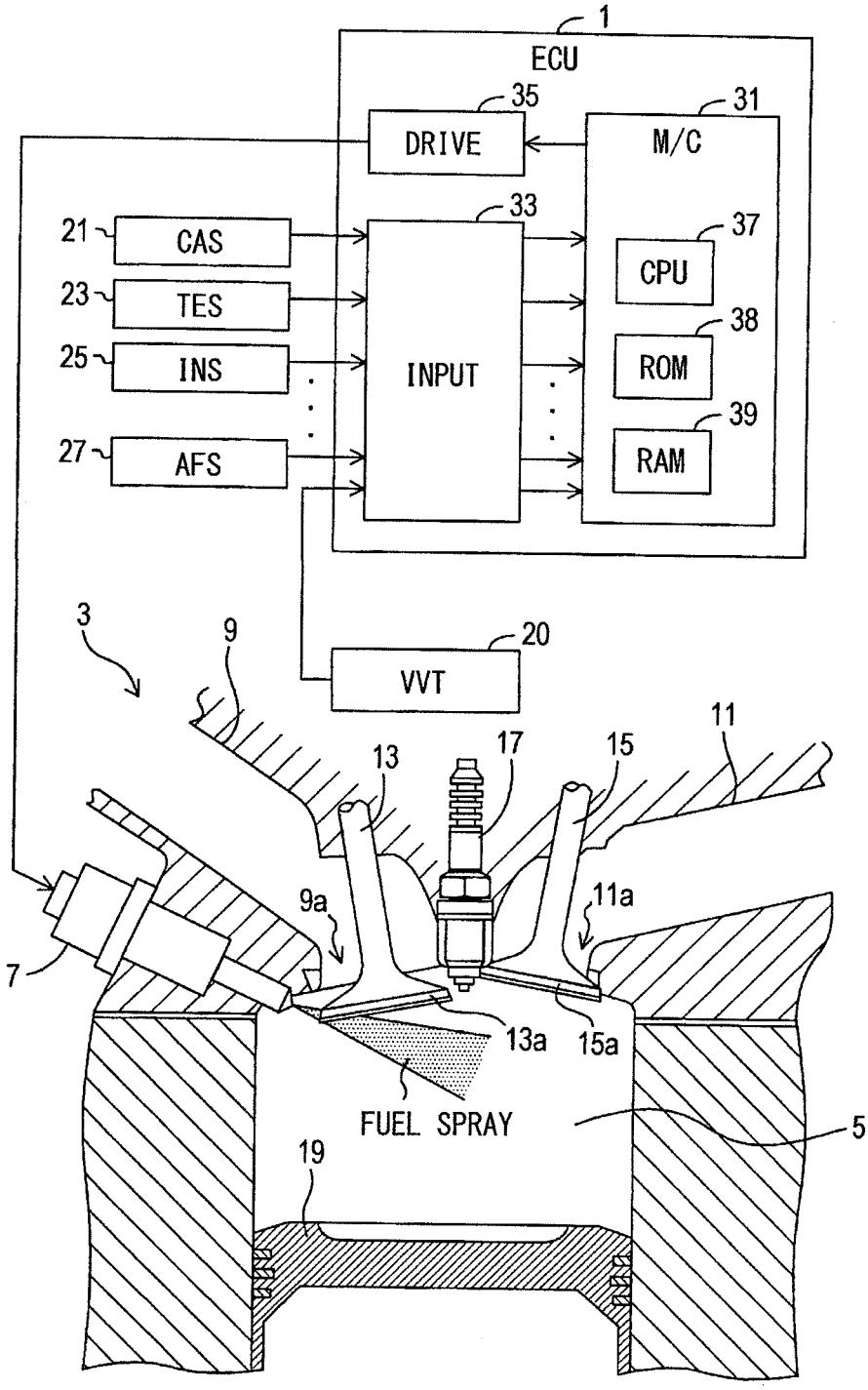
FIG. 1 is a configuration diagram illustrating a fuel injection controller and an engine according to an embodiment.

As illustrated in FIG. 1, an engine 3 to be controlled by an ECU 1 is a cylinder-direct injection engine, and includes a fuel injector 7 that injects fuel directly into a cylinder 5 of the engine 3. Further, the engine 3 includes an intake port 9, an exhaust port 11, an intake valve 13 having an umbrella portion 13*a* that opens and closes an opening portion 9*a* of the intake port 9, an exhaust valve 15 having an umbrella portion 15*a* that opens and closes an opening portion 11*a* of the exhaust port 11, an ignition plug 17, and a piston 19 that moves within the cylinder 5. Also, the engine 3 is equipped with a variable valve timing mechanism 20 that changes an opening/closing timing of at least the intake valve 13 according to a load of the engine 3.

The ECU 1 receives various sensor signals from a crank angle sensor 21 for detecting an engine speed of the engine 3 and a crank angle, a water temperature sensor 23 that detects a coolant temperature of the engine 3, an intake quantity sensor 25 that detects an intake air quantity intaken into the engine 3, and an air-fuel ratio sensor 27 that detects an air-fuel ratio. Also, the ECU 1 receives an advance/retard angle signal output from the variable valve timing mechanism 20.

A signal (hereinafter referred to as "crank angle signal") output from the crank angle sensor 21 is level-changed in a pulsed shape every time a crank shaft (not shown) of the engine 3 rotates by a given angle (for example, 30°). The advance/retard angle signal output from the variable valve timing mechanism 20 indicates, for example, how much a valve opening start crank angle of the intake valve 13 is advanced or retarded from a standard value.

The ECU 1 includes a microcomputer 31 that conducts at least processing for controlling the fuel injector 7, an input circuit 33 that inputs the above various sensor signals and the advance/retard angle signal to the microcomputer 31, and a driver circuit 35 that opens the fuel injector 7 according to an injection instruction signal from the microcomputer 31.

The microcomputer 31 includes a CPU 37, a ROM 38 in which a program and a map for calculating control information are stored, and a RAM 39 in which calculation results by the CPU 37 are stored. The operation of the microcomputer 31 described below is realized by allowing the CPU 37 to execute the program within the ROM 38.

Subsequently, processing conducted by the microcomputer 31 will be described.

The microcomputer 31 controls a fuel injection quantity and an injection timing on the basis of the various sensor signals and the advance/retard angle signal. Hereinafter, one cylinder 5 illustrated in FIG. 1 among the cylinders of the engine 3 will be described below, and the same is applied to the other cylinders.

For example, the microcomputer 31 calculates a basis injection quantity "BIQ" (refer to 320 in FIG. 2) which is a basic value of the fuel injection quantity, and an injection start timing on the basis of the engine speed and the intake air quantity. In this embodiment, for example, a crank angle at which the fuel injection starts is calculated as the injection start timing. Since a time at which the crank angle becomes a specified value can be estimated from the engine speed, the injection start timing can be converted into time. Hereinafter, the injection start timing converted into time is referred to as "time of the injection start timing."

Further, the microcomputer 31 calculates a correction term for correcting the basic injection quantity "BIQ" denoted by 320. As the correction term, as indicated within a dotted frame 301 in FIG. 2, the correction term 330 includes following terms. That is, for example, a correction term 331 of an after-start increment correction for increasing the fuel injection quantity when the engine 3 starts, a correction term 332 of a warm-up increment correction for increasing the fuel injection quantity for warm-up operation, and a correction term 333 of overcorrection for increasing or decreasing the fuel injection quantity when a load of the engine 3 rapidly changes.

Figure 2:
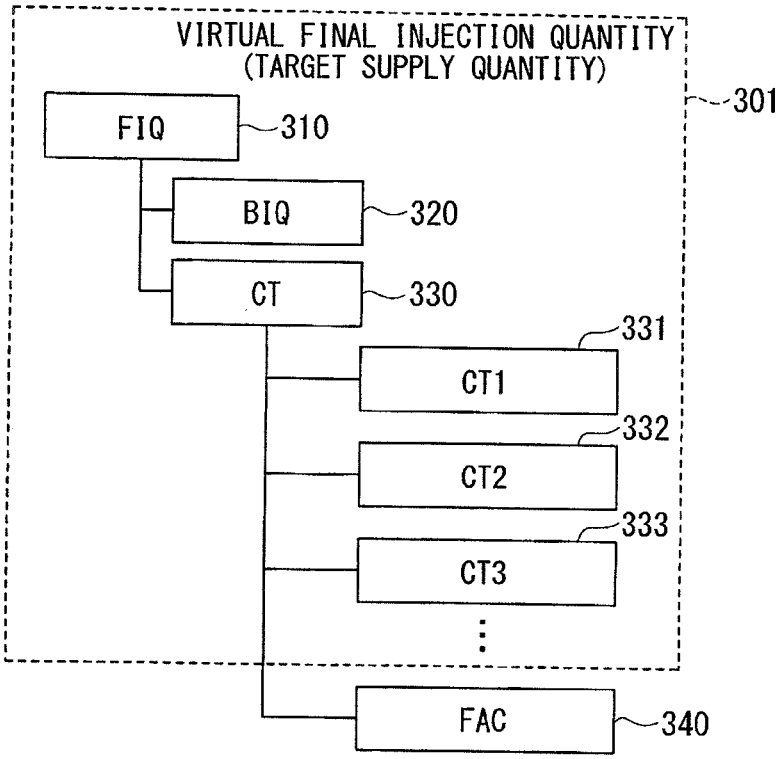
FIG. 2 is an illustrative view illustrating a process of calculating a final injection quantity.

The microcomputer 31, for example, adds the correction term to the basic injection quantity "BIQ" to calculate a final injection quantity "FIQ" (refer to 310 in FIG. 2). The added correction term may be negative. Also, for example, the correct term may be multiplied by the basic injection quantity "BIQ". Further, the basic injection quantity "BIQ" and the respective correction values are calculated, for example, with the use of the map or an arithmetic formula stored in the ROM 38.

Figure 3:
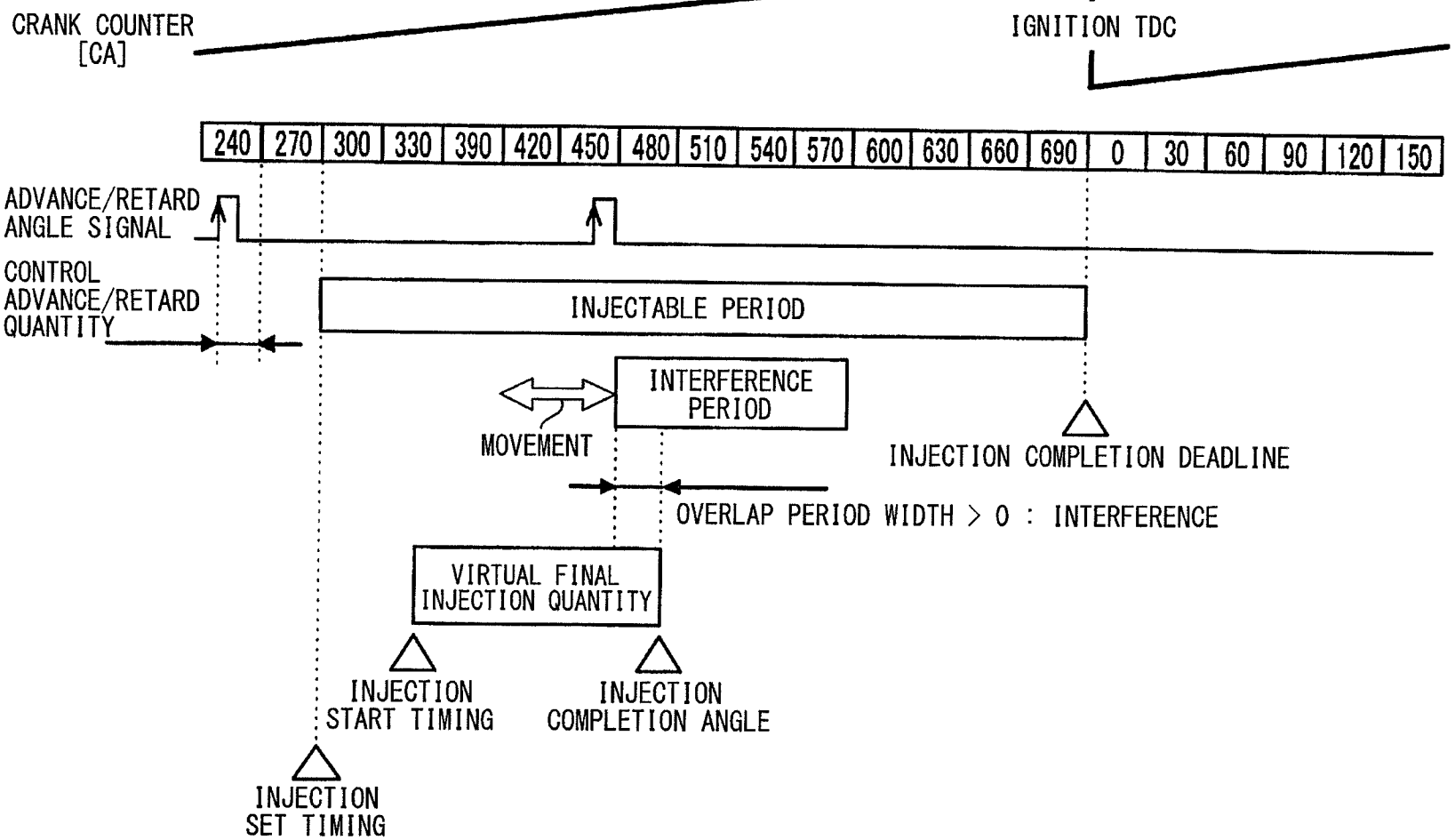
FIG. 3 is an illustrative view illustrating an injectable period and an interference period.

Also, in this embodiment, as illustrated in FIG. 3, for example, a timing of an ignition TDC (top dead center in a compression stroke) of the cylinder 5 is a termination time (hereinafter referred to as "injection completion deadline") of an injectable period in which the fuel can be injected into the cylinder 5. A timing advanced from the injection completion deadline by a given crank angle (for example, 420°CA in this embodiment) is a start time of the injectable period. It should be noted that "CA" is an abbreviation of a crank angle. Also, "crank counter" in FIG. 3 is a counter indicative of the crank angle, and sequentially updated on the basis of a crank angle signal in the ECU 1.

As illustrated in FIG. 3, the microcomputer 31 sets the start time of the injectable period as an injection set timing, and calculates the injection start timing and the final injection quantity through an injection-information-calculation processing which is executed before the injection set timing.

The injection set timing is a timing at which the microcomputer 31 sets an output start time (time when the injection instruction signal is changed to an active level) of the injection instruction signal, and an output duration time (time during which the injection instruction signal is continuously kept at the active level) of the injection instruction signal for an injection-instruction-outputting unit.

For example, the microcomputer 31 includes an injection instruction timer as the injection-instruction-outputting unit. The injection instruction timer sets the injection instruction signal to the active level for the set output duration time from the set output start time. Because the driver circuit 35 opens the fuel injector 7 while the injection instruction signal from the microcomputer 31 is kept at the active level, the microcomputer 31 sets the time of the calculated injection start timing as the output start time, and the time corresponding to the calculated fuel injection quantity as the output duration time for the injection instruction timer.

In this embodiment, the fuel may be injected from the fuel injector 7 even when the intake valve 13 is opened. For that reason, a part of the fuel injected from the fuel injector 7 has the potential to adhere to the opened intake valve 13. That is, as illustrated in FIG. 3, an interference period in which the injection fuel from the fuel injector 7 adheres to the opened intake valve 13 exists in the injectable period. The interference period is a period in which a lift quantity of the intake valve 13 in a valve opening direction is larger than a given value (≥0).

Figure 4:
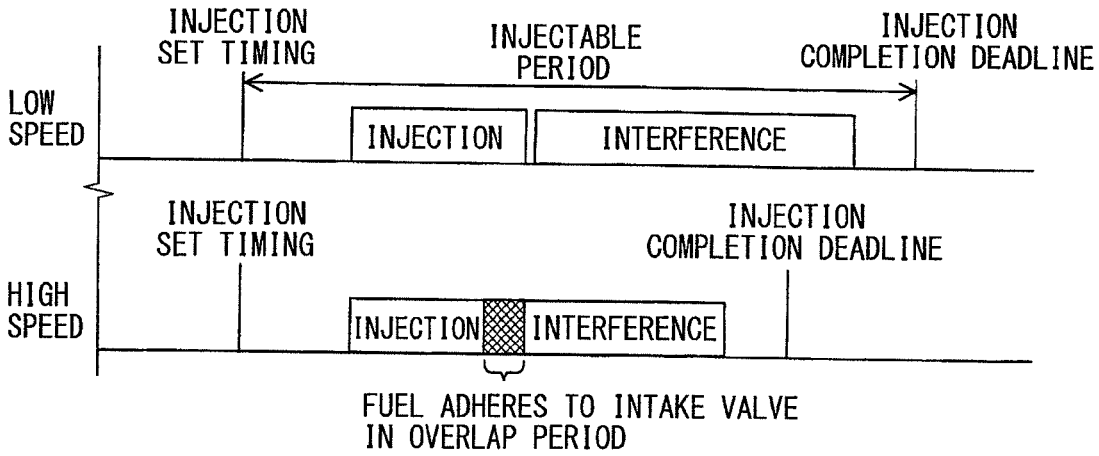
FIG. 4 is an illustrative view illustrating an adhesion of fuel to an intake valve.

As illustrated in FIG. 4, when a period (hereinafter referred to simply as "overlap period") during which the injection period of the fuel injector 7 overlaps with the interference period is generated, a part of the injection fuel adheres to the opened intake valve 13 in the overlap period. As a result, the fuel of the calculated final injection quantity cannot be supplied into the cylinder 5. The final injection quantity is calculated through the above-mentioned injection-information-calculation processing. The final injection quantity corresponds to the amount (target supply quantity) of fuel to be supplied into the cylinder 5. Also, when the engine 3 is at a high speed, the possibility that the injection period overlaps with the interference period becomes higher.

For that reason, in this embodiment, the microcomputer 31 further implements a fuel-adhere correction "FAC" with respect to the final injection quantity which has been calculated at a previous injection set timing according to the injection-information-calculation processing (refer to 340 in FIG. 2). The fuel-adhere correction is performed in order to correct the fuel injection quantity in view of the amount of fuel adhered to the intake valve 13, assuming that the fuel is adhered to the intake valve 13. That is, in this embodiment, the final injection quantity which is calculated before the injection set timing through the injection-information-calculation processing and is surrounded by a dotted frame in FIG. 2 represents a virtual final injection quantity. Also the final injection quantity is the target supply quantity of the fuel into the cylinder 5. The injection quantity obtained by conducting the fuel-adhere correction with respect to the virtual final injection quantity represents an actual injection quantity that is actually injected from the fuel injector 7.

Figure 5:
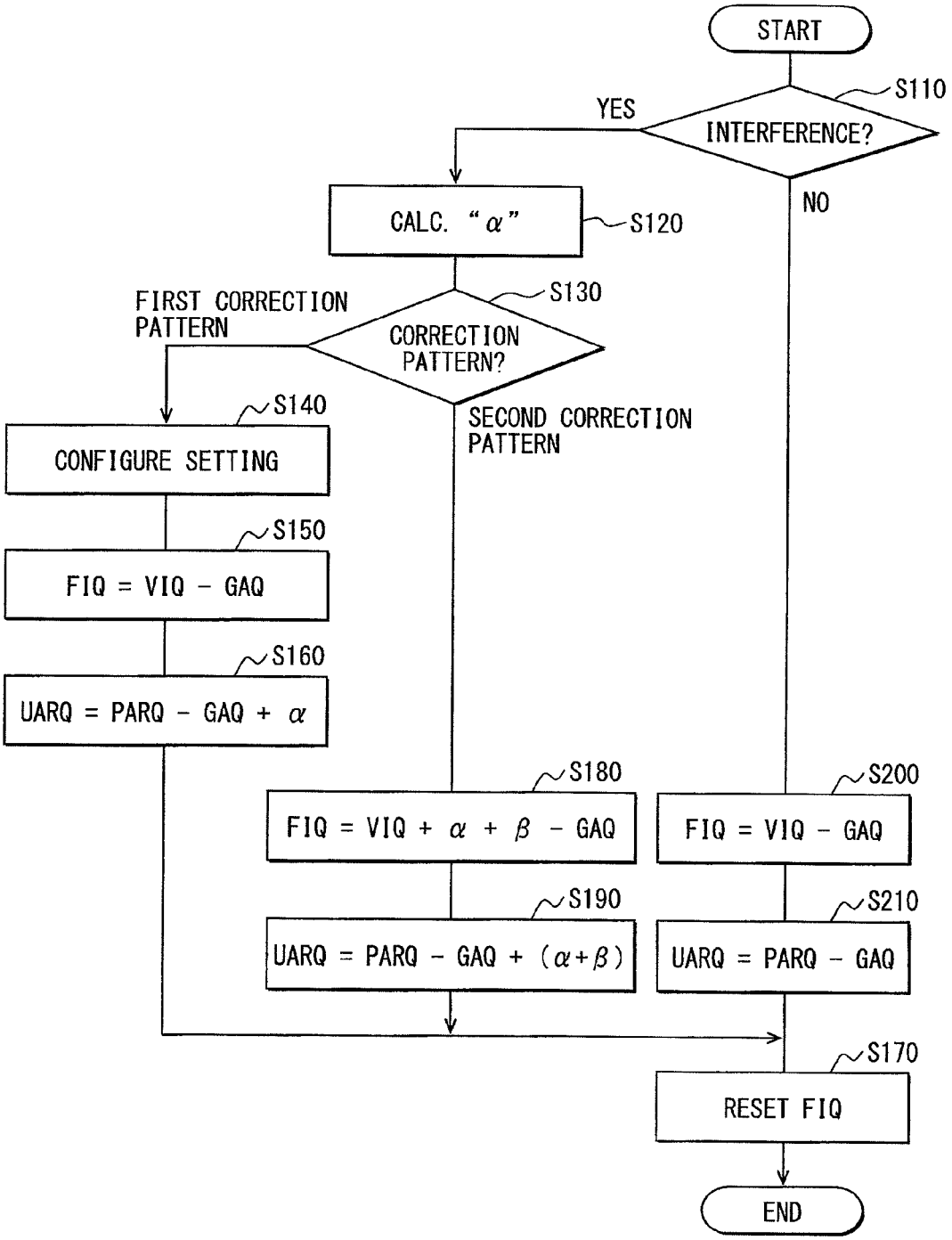
FIG. 5 is a flowchart illustrating fuel-adhere correction processing conducted by a microcomputer.

The microcomputer 31 conducts the fuel-adhere correction processing illustrated in FIG. 5. The fuel-adhere correction processing is executed at a time of the injection set timing.

As illustrated in FIG. 5, when it is the injection set timing to start the fuel-adhere correction processing, the microcomputer 31 determines whether the injection fuel from the fuel injector 7 interferes with the intake valve 13 in S110.

Specifically, it is assumed that the fuel of the virtual final injection quantity (target supply quantity) calculated in the injection-information-calculation processing is injected at the injection start timing calculated in the injection-information-calculation processing. The microcomputer 31 determines whether the injection period (hereinafter referred to as "original injection period") overlaps with the above-mentioned interference period.

In more detail, the microcomputer 31 calculates an injection completion angle which is a crank angle at which the original injection period is terminated through the following Formula 1 (refer to FIG. 3).

$$\text{(Injection completion angle)}=\text{(Injection start timing)}+\text{(Value obtained by converting virtual final injection quantity into a width of crank angle)} \quad (1)$$

A unit of the injection start timing in Formula 1 is the crank angle. Also, the virtual final injection quantity can be converted into the injection time period, and the injection time period can be converted into the width of the crank angle on the basis of the engine speed.

Also, the microcomputer 31 detects an advance/retard angle quantity (hereinafter referred to as "control advance/retard quantity") of the valve opening start crank angle of the intake valve 13 relative to a reference value by the variable valve timing mechanism 20 on the basis of the advance/retard angle signal input before the present injection set timing.

In this embodiment, as illustrated in FIG. 3, a difference between the crank angle of when an effective edge (rising edge in this example) is generated in the advance/retard angle signal, and a specific crank angle (270°CA in FIG. 3) before the injection set timing represents a controlled advance/retard angle signal. For example, when the effective edge of the advance/retard angle signal is generated before the specified crank angle, the difference represents the retard angle. Also, for example, a positive of the controlled advance/retard angle quantity represents the advance angle, and a negative thereof represents the retard angle. For that reason, the microcomputer 31 detects the controlled advance/retard angle quantity by subtracting the crank angle of when the effective edge is generated in the advance/retard angle signal from the above specified crank angle.

The actual interference period moves before or after the reference interference period by the controlled advance/retard angle quantity as shown by an arrow represented as "MOVEMENT" in FIG. 3. For that reason, the microcomputer 31 calculates the period moved from the reference interference period by the detected controlled advance/retard angle quantity as the actual interference period. In this embodiment, the interference period is a period represented as an area of the crank angle, and represents an interval from one crank angle to another crank angle.

Further, the microcomputer 31 calculates an overlap period width which is a width of the period (hereinafter referred to particularly as "original overlap period") in which the original injection period overlaps with the interference period according to the following Formula 2.

$$\text{(Overlap period width)}=\text{(Injection completion angle)}-\text{(Start position of interference period)} \quad (2)$$

In Formula 2, "start position of the interference period" corresponds to the crank angle at which the calculated interference period starts.

The microcomputer 31 determines whether the overlap period width calculated through Formula 2 is positive (that is, larger than 0). When the overlap period width is positive, the original injection period overlaps with the interference period. Therefore, the microcomputer 31 determines that the injection fuel interferes with the intake valve 13. Conversely, unless the calculated overlap period width is positive, the microcomputer 31 determines that the injection fuel does not interfere with the intake valve 13.

When the microcomputer 31 determines in S110 that the injection fuel interferes with the intake valve 13, the microcomputer 31 proceeds to S120 in which a fuel-adhered quantity $\alpha$ is calculated. When it is assumed that the fuel of the virtual final injection quantity (target supply quantity) is injected from the injection start timing, the fuel-adhered quantity $\alpha$ represents the amount of fuel adhered to the opened intake valve 13.

Figure 6:
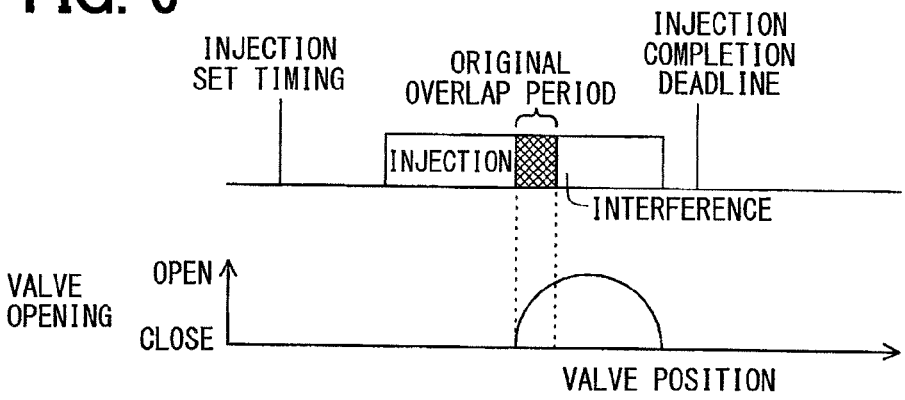
FIG. 6 is an image diagram illustrating a correlation between the amount of fuel adhered to an intake valve and a position of the intake valve.

Specifically, the microcomputer 31 first calculates a position of the intake valve 13 at the termination time of the original overlap period. As illustrated in FIG. 6, the position of the intake valve 13 is a position in a time duration since the intake valve 13 starts to be opened until the intake valve 13 is closed. In FIG. 6, a position of the intake valve 13 is described as "valve position", and the amount of lift in the intake valve 13 is described as "valve opening".

The position of the intake valve 13 at the start position (crank angle at which the interference period starts) of the interference period has been well known. Therefore, the position of the intake valve 13 (the position of the intake valve 13 at the termination time of the original overlap period) at a timing when the crank angle is advanced by the overlap period width calculated based on Formula 2 can be also calculated from the start position. The termination time of the original overlap period also represents the termination time of the original injection period, which is the timing of the injection completion angle calculated based on Formula 1.

As is understood from FIG. 6, the amount (that is, fuel-adhered quantity $\alpha$) of fuel adhered to the intake valve 13 in the original overlap period has a correlation with an integral value of the opening (the amount of lift) of the intake valve 13 in the original overlap period, and changes according to at least the position of the intake valve 13 at the termination time of the original overlap period. For that reason, for example, a fuel-adhered quantity calculation map is stored in the ROM 38. In view of the map, the fuel-adhered quantity $\alpha$ is calculated based on the position of the intake valve 13 at the termination time of the original overlap period and the information (hereinafter referred to as "operating state information") representing the operating state of the engine 3. The microcomputer 31 applies the position of the intake valve 13 at the termination time of the original overlap period, and the operating state information to the fuel-adhered quantity calculation map to calculate the fuel-adhered quantity $\alpha$. The operating state information includes, for example, at least one or more of an intake load factor of the engine 3, the engine speed, and the coolant temperature.

Subsequently, the microcomputer 31 discriminates whether the correction pattern of the fuel injection quantity is set to a first correction pattern or a second correction pattern, in S130.

Figure 7:
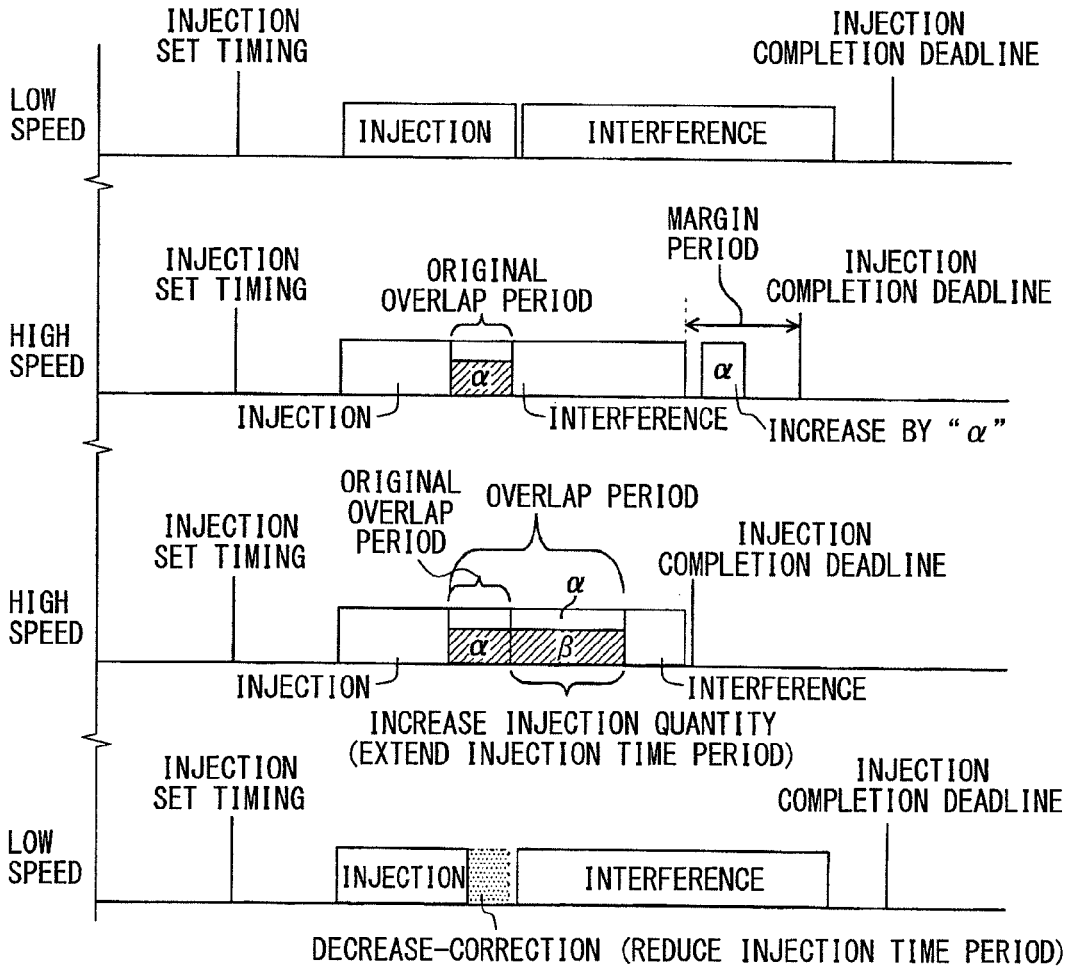
FIG. 7 is an illustrative view illustrating an action of the fuel-adhere correction processing.

As indicated in FIG. 7, the first correction pattern is a correction pattern in which the fuel of the fuel-adhered quantity α is injected by the fuel injector 7 in the margin period from the termination time of the interference period to the termination time (injection completion deadline) of the injectable period, to thereby increase the fuel injection quantity from the virtual final injection quantity, and prevent the fuel supplied into the cylinder 5 from running short.

The second correction pattern is a correction pattern when the fuel of the fuel-adhered quantity α cannot be injected from the fuel injector 7 during the margin period because the margin period is shorter. As indicated in FIG. 7, in the second correction pattern, a fuel injection time period from the injection start timing extends so that the fuel of the fuel-adhered quantity α flows into the cylinder 5, to thereby increase the fuel injection quantity from the virtual final injection quantity. Because the margin period is shorter as the engine 3 rotates at a higher speed, the correction pattern is likely to become the second correction pattern more than the first correction pattern.

The microcomputer 31 converts a crank angle width from a crank angle at which the interference period is terminated to a crank angle corresponding to the injection completion deadline into time on the basis of the engine speed in S130. The converted time is a length of the margin period. Further, the microcomputer 31 determines whether the length of the margin period is larger than an injection time period of the fuel-adhered quantity α (that is, injection time period necessary to inject the fuel of the fuel-adhered quantity α from the fuel injector 7). For example, when "length of margin period≥(injection time period of the fuel-adhered quantity α+given margin time)", the microcomputer 31 determines that the fuel of the fuel-adhered quantity α can be injected by the fuel injector 7 in the margin period, and determines that the correction pattern is set to the first correction pattern. Conversely, when "length of margin period<(injection time period of the fuel-adhered quantity α+given margin time)", the microcomputer 31 determines that the fuel of the fuel-adhered quantity α cannot be injected by the fuel injector 7 in the margin period, and determines that the correction pattern is set to the second correction pattern.

When the microcomputer 31 determines that the correction pattern is set to the first correction pattern in S130, the microcomputer 31 proceeds to S140.

Then, the microcomputer 31 configures a setting for implementing the fuel injection of the fuel-adhered quantity α during the margin period after the interference period termination in S140, as indicated in FIG. 7.

For example, the microcomputer 31 includes a second timer for outputting an injection command signal, aside from a first timer which is an injection instruction timer for outputting the injection instruction signal (in detail, setting the injection instruction signal to the active level) from the injection start timing (hereinafter referred to also as "original injection start timing") calculated in the injection-information-calculation processing. Then, the microcomputer 31 sets a time at which the interference period is terminated, or a time later than the time at which the interference period is terminated by a given time shorter than the above margin time, as the output start time of the injection instruction signal, for the second timer. Further, the microcomputer 31 sets the injection time period for injecting the fuel of the fuel-adhered quantity α as the output duration time of the injection instruction signal for the second timer. Because the crank angle at which the interference period is terminated is found, the microcomputer 31 can calculate the time (that is, the time at which the interference period is terminated) at which the crank angle is obtained, according to the engine speed.

Subsequently, the microcomputer 31 calculates the fuel injection quantity (that is, the amended fuel injection quantity) actually injected from the original injection start timing through the following Formula 3 in S150.

$$\text{(Final injection quantity FIQ)}=\text{(Virtual final injection quantity VIQ)}-\text{(Gasification quantity GAQ)} \quad (3)$$

The adhered residual represents the fuel that has been already adhered to the intake valve 13, and the gasification quantity from the adhered residual represents the fuel quantity that is gasified and flows into the cylinder 5.

The gasification quantity from the adhered residual is calculated according to the updated amount of adhered residual (hereinafter referred to as "adhered residual quantity") which is calculated in any one of S160, S190, and S210, which will be described later. For example, a gasification quantity calculation map for calculating the gasification quantity according to the adhered residual quantity and other information (for example, the above-mentioned operating state information) is stored in the ROM 38. Hence, the microcomputer 31 applies the adhered residual quantity and other information to the gasification quantity calculation map to calculate the gasification quantity from the adhered residual. When there is no adhered residual (adhered residual quantity=0), the gasification quantity from the adhered residual is "0".

The microcomputer 31 calculates the updated adhered residual quantity according to the following Formula 4 in subsequent S160. That is, the microcomputer 31 updates a calculated value of the adhered residual quantity.

$$\text{(Updated adhered residual quantity UARQ)}=\text{(Previous adhered residual quantity PARQ)}-\text{(Present gasification quantity GAQ)}+\text{(Present adhesion quantity }\alpha\text{)} \quad (4)$$

The previous adhered residual quantity in Formula 4 represents the adhered residual quantity immediately before being updated in S160, which is the adhered residual quantity used for calculating the gasification quantity in Formula 3 in the above S150. Also, the present gasification quantity in Formula 4 represents the gasification quantity calculated in S150. Also, the present adhesion quantity in Formula 4 represents the amount of fuel expected to be adhered to the intake valve 13 by the fuel injection implemented from now, which is the fuel-adhered quantity α calculated in S120 in this case.

The microcomputer 31 then proceeds to S170, and resets the final injection quantity FIQ.

Specifically, the microcomputer 31 sets the time of the original injection start timing as the output start time of the injection instruction signal, and sets the injection time period for injecting the fuel of the final injection quantity (that is, the amended final injection quantity) calculated in the fuel-adhere correction processing as the output duration time of the injection instruction signal, for the above-mentioned first timer. Thereafter, the microcomputer 31 completes the fuel-adhere correction processing.

On the other hand, when the microcomputer 31 determines that the correction pattern is set to the second correction pattern in S130, the microcomputer 31 proceeds to S180.

The microcomputer 31 calculates the corrected final injection quantity in the second correction pattern through the following Formula 5 in S180.

(Final injection quantity FIQ)=(Virtual final injection quantity VIQ)+(α+β)−(Gasification quantity from adhered residual GAQ) (5)

In Formula 5, (α+β) represents an injection increment for sucking the fuel of the fuel-adhered quantity α into the cylinder 5 in an overlap period subsequent to the original overlap period as indicated in FIG. 7. The amount α in the injection increment (α+β) represents the amount of fuel intaken into the cylinder 5, and the amount 13 represents the amount of fuel adhered to the intake valve 13.

Also, the necessary injection increment (α+β) changes according to at least the fuel quantity (=fuel-adhered quantity α) to be intaken into the cylinder 5, and the position of the intake valve 13 at the termination time of the original overlap period. For that reason, for example, an increment calculation map for calculating the injection increment according to the fuel quantity to be intaken into the cylinder 5, the position of the intake valve 13 at the termination time of the original overlap period, and the operating state information is stored in the ROM 38. The microcomputer 31 applies the position of the intake valve 13 at the termination time of the original overlap period and the operating state information. Also the microcomputer 31 applies the fuel-adhered quantity α as the fuel quantity to be intaken into the cylinder 5 to the increment calculation map, to thereby calculate the injection increment (α+β).

Also, the "gasification quantity from the adhered residual" in Formula 5 is calculated in the same procedure as that of "gasification quantity from the adhered residual" in Formula 3.

The microcomputer 31 calculates the updated adhered residual quantity through the following Formula 6 in subsequent S190.

(Updated adhered residual quantity UARQ)=(Previous adhered residual quantity PARQ)−(Present gasification quantity GAQ)+(Present adhesion quantity α+β) (6)

The previous adhered residual quantity in Formula 6 represents the adhered residual quantity immediately before being updated in S190, which is the adhered residual quantity used for calculating the gasification quantity in Formula 5 in the above S180. Also, the present gasification quantity in Formula 6 represents the gasification quantity calculated in S180. Also, the present adhesion quantity in Formula 6 represents the amount of fuel expected to be adhered to the intake valve 13 by the fuel injection implemented from now, which is the value (=α+β) in which the fuel-adhered quantity α is added to the value (−β) obtained by subtracting α which is the amount intaken into the cylinder 5 from the injection increment (α+β) calculated in S180, which is consequently the same value as the injection increment (α+β).

Then, the microcomputer 31 proceeds to the above-mentioned S170, and resets the final injection quantity, and thereafter completes the fuel-adhere correction processing.

Also, when the microcomputer 31 determines that the injection fuel does not interfere with the intake valve 13 in the above S110, the microcomputer 31 proceeds to S200, and calculates the amended final injection quantity through the above-mentioned Formula 3 in the same manner as that in S150.

Then, the microcomputer 31 calculates the updated adhered residual quantity according to the following Formula 7 in subsequent S210.

(Updated adhered residual quantity UARQ)=(Previous adhered residual quantity PARQ)−(Present gasification quantity GAQ) (7)

In this Formula 7, a term to which the present adhesion quantity is added is deleted as compared with the above-mentioned Formula 4 or Formula 6. In this case, the answer in S110 is "NO: no interference" because the fuel is not newly adhered to the intake valve 13 by the fuel injection implemented from now.

Then, the microcomputer 31 proceeds to the above-mentioned S170, and resets the final injection quantity, and thereafter completes the fuel-adhere correction processing.

Subsequently, the action of the fuel-adhere correction processing will be described with reference to FIG. 7.

When the engine speed increases (becomes higher), or the final injection quantity (virtual final injection quantity) calculated in the injection-information-calculation processing increases so that the original injection period overlaps with the interference period, the fuel-adhered quantity α in the original overlap period in which the original injection period overlaps with the interference period is calculated through the processing in S120. The fuel-adhered quantity α represents an estimate of the fuel quantity adhered to the intake valve 13 in the present original overlap period.

When the fuel of the fuel-adhered quantity α can be injected by the fuel injector 7 in the margin period from the termination time of the interference period to the injection termination deadline as indicated in FIG. 7, the correction pattern of the fuel injection quantity becomes the first correction pattern.

In the first correction pattern, the fuel injection of the fuel-adhered quantity α is implemented during the margin period after the interference period termination through processing of S140. For that reason, the fuel quantity to be supplied into the cylinder 5 is prevented from being reduced from the target supply quantity due to the adhesion of fuel to the intake valve 13.

Further, in the first correction pattern, the final injection quantity injected from the original injection start timing is corrected to a value obtained by subtracting the gasification quantity from the adhered residual from the virtual final injection quantity (refer to Formula 3). For that reason, the fuel quantity to be supplied into the cylinder 5 is prevented from increasing by the gasification quantity from the adhered residual.

On the other hand, when the fuel of the fuel-adhered quantity α cannot be injected by the fuel injector 7 in the margin period from the termination time of the interference period to the injection completion deadline as indicated in FIG. 7, the correction pattern of the fuel injection quantity becomes the second correction pattern.

In the second correction pattern, the final injection quantity injected from the original injection start timing is corrected to a value increasing from the virtual final injection quantity by the above (α+β), and decreasing from the adhered residual by the gasification quantity through the processing of S180 (refer to Formula 5). For that reason, the fuel quantity to be supplied into the cylinder 5 is prevented from being reduced from the target supply quantity due to the adhesion of fuel to the intake valve 13, and also prevented from increasing by the gasification quantity from the adhered residual.

Also, when the engine speed decreases (becomes lower), or the final injection quantity (virtual final injection quantity) calculated in the injection-information-calculation processing decreases so that the original injection period does not overlap with the interference period as indicated in FIG. 7, an increment correction is not conducted on the fuel injection quantity. Only a decrement correction in view of the gasification quantity from the adhered residual is conducted on the fuel injection quantity in S200.

That is, the final injection quantity injected from the original injection start timing is corrected to a value obtained by subtracting the gasification quantity from the adhered residual from the virtual final injection quantity in S200. For that reason, the injection time period from the original injection start timing is reduced from the length of the original injection period by a time corresponding to the gasification quantity from the adhered residual. Thereafter, when the adhered residual calculated in S210 becomes "0", the decrement correction through the processing of S200 is not substantially conducted. That is, the final injection quantity calculated in S200 becomes the same value as that of the virtual final injection quantity.

The above-mentioned respective maps can be set by both or one of theoretical calculation and experiment.

As described above, in the ECU 1 according to this embodiment, the fuel injection quantity is corrected according to the fuel-adhered quantity $\alpha$ assuming that the injection fuel from the fuel injector 7 is adhered to the intake valve 13. For that reason, the appropriate amount of fuel can be supplied into the cylinder 5 to more improve an air-fuel ratio (A/F), and avoid the degradation of emission and a reduction in an engine output. Also, in an air-fuel ratio feedback control for correcting the fuel injection quantity according to the detected air-fuel ratio, a response delay of the correction occurs. On the other hand, in the correction of this embodiment, such a delay in the feedback control does not occur.

In the ECU 1, in order to conduct the fuel injection in the interference period, there is no need to conduct the overall fuel injection for the injection period that overlaps with the interference period, after the interference period as in the related art. Hence, even when the margin period from the termination time of the interference period to the injection completion deadline is shorter, the appropriate amount of fuel can be supplied into the cylinder 5. In particular, the microcomputer 31 conducts the correction (S140 or S180) for increasing the fuel injection quantity injected from the fuel injector 7 according to the fuel-adhered quantity $\alpha$ calculated in S120 of FIG. 5. As a result, the supply fuel quantity into the cylinder 5 can be prevented from being reduced from the target supply quantity due to the adhesion of fuel to the intake valve 13.

Also, when the microcomputer 31 determines that the fuel of the fuel-adhered quantity $\alpha$ can be injected by the fuel injector 7 in the margin period, the microcomputer 31 allows the fuel injector 7 to inject the fuel of the fuel-adhered quantity $\alpha$ during the margin period, to thereby increase the fuel injection quantity (S140). For that reason, the increment correction of the fuel injection quantity can be efficiently implemented. As compared with the configuration in which the fuel injection in the interference period is prohibited, and the overall fuel injection for the injection period that overlaps with the interference period is conducted after the termination of the interference period, the amount of fuel to be injected after the termination of the interference period can be reduced. As a result, even when the margin period is shorter, the appropriate amount of fuel can be supplied into the cylinder 5.

Also, when the microcomputer 31 determines that the fuel of the fuel-adhered quantity $\alpha$ cannot be injected by the fuel injector 7 in the margin period, the microcomputer 31 extends the fuel injection time period from the original injection start timing by an amount corresponding to the above-mentioned fuel increment ($\alpha+\beta$) so that the fuel of the fuel-adhered quantity $\alpha$ enters the cylinder 5 (S180). For that reason, even when the margin period is shorter (even when the margin period is "0"), the increment correction of the fuel injection quantity can be implemented.

Further, the microcomputer 31 calculates the adhered residual quantity (S160, S190, S210), calculates the gasification quantity from the adhered residual on the basis of the adhered residual quantity, and conducts the correction for decreasing the final injection quantity from the original injection start timing by the gasification quantity (S150, S180, S200). For that reason, the fuel quantity to be supplied into the cylinder 5 is prevented from increasing by the gasification quantity from the adhered residual so that a control precision of the fuel supply into the cylinder 5 can be further improved.

Also, the microcomputer 31 calculates the fuel-adhered quantity $\alpha$ and ($\alpha+\beta$) which is the injection increment according to the position of the intake valve 13 at the termination time of the original overlap period. As a result, the microcomputer 31 can calculate those values with high precision.

Modification 1

The microcomputer 31 may conduct processing in which S130 to S160 are deleted from the fuel-adhere correction processing of FIG. 5. That is, the microcomputer 31 may be configured to implement the correction of the second correction pattern as the correction of the fuel injection quantity regardless of the length of the margin period.

Modification 2

The microcomputer 31 can output the injection instruction signal by timer interrupt processing.

For example, the microcomputer 31 sets an interrupt generation timer so that a timer interrupt is generated at the time of the original injection start timing in S170 of FIG. 5. Then, the microcomputer 31 sets the injection instruction signal to the active level through subsequent timer interrupt processing, and sets the interrupt generation timer so that a second timer interrupt is generated when the injection time period for injecting the fuel of the corrected final injection quantity elapses from that active level setting time point. Then, the microcomputer 31 can set the injection instruction signal to an inactive level through the second timer interrupt processing.

In this case, the microcomputer 31 can conduct the following processing instead of the processing of S140 in FIG. 5.

The microcomputer 31 further sets the interrupt generation timer so that a third timer interruption is generated at a time when the interference period is terminated, or at a time later than the time when the interference period is terminated by the above-mentioned given time, through the above second timer interrupt processing. Then, the microcomputer 31 sets the injection instruction signal to the active level through the third timer interrupt processing, and sets the interrupt generation timer so that a fourth timer interrupt is generated when the injection time period for injecting the fuel of the fuel-adhered quantity $\alpha$ elapses from that active level setting time point. Then, the microcomputer 31 can set the injection instruction signal to the inactive level through the fourth timer interrupt processing.

Modification 3

As learning of the correction quantity of the fuel injection quantity, the microcomputer 31 may be configured to determine whether the correction quantity is appropriate. On the basis of the signal from the air-fuel ratio sensor 27, the microcomputer 31 calculates a learning value for adjusting (increasing or decreasing) the correction quantity and stores the learning value in a rewritable non-volatile memory for each cylinder. The learning value can be used for adjusting the correction quantity to cope with aging deterioration of the engine 3 including the fuel injector 7 and the variable valve timing mechanism 20.

For example, the learning value conceivably includes a learning value for increasing or decreasing the fuel-adhered quantity $\alpha$ (that is, the injection quantity after termination of the interference period) used in S140 of FIG. 5, a learning value for increasing or decreasing the injection increment ($\alpha+\beta$) used to calculate the final injection quantity in S180 of FIG. 5, and a learning value for increasing or decreasing the gasification quantity used to calculate the final injection quantity in S150, S180, and S200 of FIG. 5. For example, in order to calculate the final injection quantity, the learning value may include a value of a new correction term to be added to or subtracted from the virtual final injection quantity.

The learning value may be set so that the fuel injection quantity becomes smaller as the actual air-fuel ratio detected by a signal from the air-fuel ratio sensor 27 is richer, or so that the fuel injection quantity becomes larger as the actual air-fuel ratio is leaner.

The embodiment of the present invention has been described above. However, the present invention is not limited to the above embodiment, but the various forms can be implemented without departing from the spirit of the present invention described in the claims. A modification in which any combination of the configurations and processing of the above-mentioned embodiment is changed, or a modification in which a part of the configurations and processing is deleted can be conducted. Also, the above-mentioned values are exemplary.

For example, the microcomputer 31 may be configured to calculate any one of the fuel-adhered quantity $\alpha$, the injection increment ($\alpha+\beta$), and the gasification quantity from the adhered residual may be calculated by a preset calculation formula.

Also, the decrement correction for subtracting the gasification quantity from the virtual final injection quantity may not be implemented. In that case, the processing (S160, S190, S210) for calculating the adhered residual quantity can be removed from the processing of FIG. 5.

What is claimed is:

1. A fuel injection controller for controlling a fuel injector that injects a fuel directly into a cylinder of an engine, comprising:

a correction unit correcting a fuel injection quantity injected from the fuel injector according to a fuel-adhered quantity which is an amount of the fuel adhered to an opened intake valve, a determination unit determining a target supply quantity which is an amount of the fuel to be supplied into the cylinder, the determination unit determining an injection start timing of the fuel from the fuel injector, wherein the correction unit includes an adhesion quantity calculation unit calculating the fuel-adhered quantity assuming that the fuel injector injects the fuel of the target supply quantity at the injection start timing, the correction unit conducts a correction in such a manner as to increase the fuel injection quantity injected from the fuel injector according to the fuel-adhered quantity, the correction unit includes a determination unit determining whether the fuel of the fuel-adhered quantity is injectable by the fuel injector in a margin period from a termination time of an interference period in which the fuel injected from the fuel injector is adhered to the opened intake valve to a termination time of an injectable period in which the fuel can be injected into the cylinder, and when the determination unit determines that the fuel of the fuel-adhered quantity is injectable, the correction unit allows the fuel injector to inject the fuel of the fuel-adhered quantity in the margin period to increase the fuel injection quantity injected from the fuel injector.

2. The fuel injection controller according to claim 1, wherein when the determination unit determines that the fuel of the fuel-adhered quantity is not injectable, the correction unit extends the fuel injection time period from the injection start timing according to the fuel-adhered quantity to increase the fuel injection quantity injected from the fuel injector.

3. The fuel injection controller according to claim 1, wherein the correction unit includes a residual quantity calculation unit calculating an amount of an adhered residual fuel which has been already adhered to the intake valve, the correction unit calculates a gasification quantity which is an amount of the adhered residual fuel which is gasified and flows into the cylinder based on the amount of adhered residual, and the correction unit conducts a correction to decrease the fuel injection quantity by the gasification quantity.

* * * * *